US005435771A

United States Patent [19]

Gregory

[11] Patent Number: 5,435,771

[45] Date of Patent: Jul. 25, 1995

[54] METHOD AND APPARATUS FOR SHARPENING SCALLOPED-EDGE BLADES

[75] Inventor: J. Lee Gregory, Richmond, Va.

[73] Assignee: Philip Morris Incorporated, New York, N.Y.

[21] Appl. No.: 182,443

[22] Filed: Jan. 18, 1994

[51] Int. Cl.[6] ..... B24B 3/58

[52] U.S. Cl. ..... 451/45; 451/421; 451/208; 451/192

[58] Field of Search ..... 51/285, 246, 249, 247, 51/87 BS, 80 BS, 80 A; 451/45, 419, 420, 421, 208, 190, 192

[56] References Cited

U.S. PATENT DOCUMENTS

| | | | |
|---|---|---|---|
| 1,053,331 | 2/1913 | Waring | 51/246 |
| 2,961,809 | 11/1960 | Hansen | 51/246 |
| 2,997,825 | 8/1961 | Hansen | 51/246 |
| 3,036,408 | 5/1962 | Hansen | 51/285 |
| 3,060,650 | 10/1962 | Hansen | 51/246 |
| 4,309,930 | 1/1982 | Wright | 83/820 |
| 4,528,777 | 7/1985 | Bernstein et al. | 51/285 |
| 4,829,721 | 5/1989 | Wright | 51/246 |

*Primary Examiner*—Robert A. Rose
*Attorney, Agent, or Firm*—Burns, Doane, Swecker & Mathis

[57] ABSTRACT

A sharpening apparatus for sharpening scalloped-edged blades in a carton slitting machine includes at least two rotating cylindrical hones mounted on a pneumatically controlled actuator. A sharpening operation is initiated by a machine operator as needed to maintain blade sharpness, and is performed automatically by the apparatus controls. The actuator positions the rotating hones in contact with opposing sides of a cutting edge of the slitting blade as the blade moves past the hones at reduced speed. A first hone is rotated in a direction opposite to the direction of the blade and a second hone is rotated in the same direction of the blade. During sharpening, the hones execute several reciprocating axial movements to stroke the blade.

23 Claims, 5 Drawing Sheets

32
68
66
64
70
49
51
65
58
62
48
60
50
52
56
54
44
46
40
42
36
38
36a
16a
16
38a
72
74
F

METHOD AND APPARATUS FOR SHARPENING SCALLOPED-EDGE BLADES

FIELD OF THE INVENTION

The present invention relates to sharpening a scalloped-edged endless band blade in a machine, particularly for slitting cigarette cartons. The apparatus of the present invention includes first and second hones which engage the cutting edge of a scalloped-edged blade and both rotate at high speed and execute reciprocating axial movements to sharpen the cutting edge.

BACKGROUND AND SUMMARY OF THE INVENTION

Slitting machines with scalloped edged blades are used in the smoking products industry for slitting open cartons and packages of cigarettes to recover tobacco rods, which are then fed to ripper machines to reclaim tobacco and tobacco filler for use in other products. A problem involved in slitting cartons to recover tobacco is that, when the slitting blades become dull, the blades shred or rip, rather than cut cleanly, the packaging materials. The shredded paper, paperboard, plastic wrapper, foil and cigarette filter material become mixed in with and contaminate the recovered tobacco filler, creating quality control problems and drastically decreasing the value of the reclaimed tobacco.

The use of well sharpened blades greatly reduces the amount of paper that gets mixed in reclaimed tobacco filler. Maintaining sharp blades in slitting machines proves to be difficult in practice, however. Slitting cigarette cartons and packages is a high wear process and blades dull to unacceptable quality levels quickly, often after cutting only a few hundred cartons. Current practice is to use edge hardened blades until the cutting edges dull, and then replace the blades, a practice which is costly in both maintenance time and blade replacement cost. Furthermore, blade changes are so frequently necessary, as often as several times per hour in high volume operations, that it is not feasible to stop the slitting process to replace the blades each time the edges become dull. Many in the industry simply change blades once or twice each shift, and accept the loss in value for tobacco reclaimed with dull blades.

U.S. Pat. No. 4,829,721 to Wright discloses a honing apparatus for sharpening endless band type blades used in bun slicing machines in the bread industry. The Wright patent apparatus includes a supporting frame holding a pair of fixed elongated hones. The frame is positioned on a bun slicing machine with the hones in proximity with a cutting blade. During the sharpening procedure, the frame is moved so that the hones are positioned at either side of a blade, and the frame is then tilted so that the hones contact both sides of the cutting edge. Sharpening of the blade is effected by the movement of the blade past the hone. The hones also perform two reciprocating strokes in the plane of the blade path during the sharpening procedure.

The Wright apparatus has limitations that make it impractical for use to sharpen blades on a carton slitting machine. Only a small constant area of the hones contacts the blades during a sharpening procedure, and over time the hones are prone to developing flats and loss of abrasive at the contact area. The hones in the Wright patent apparatus must be manually rotated between sharpening operations to expose fresh abrasive to the blades. Because the blades in a carton slitting machine can require sharpening after a few hundred cartons (usually a few minutes), manual adjustments would be labor and time intensive. In addition, carton slitters must cut through plastic and other packaging material which can collect on the blade. During sharpening, this residue can build up on and foul the hones.

Furthermore, it appears that the sharpening operation is done at the relatively slow speed of the moving bun slicing blade. The finish on the blade in this type of honing operation is unacceptable for a carton slitting operation.

The present invention, generally, provides a blade sharpening apparatus for scalloped edged blades in carton slitting machines.

More particularly, the present invention provides a blade sharpening apparatus that can be selectively utilized to sharpen blades in a carton slitting machine without removing the blades from the machine.

The present invention provides a blade sharpening apparatus which hones carton slitting blades to a sharpness required to maintain quality standards that will avoid introducing paper and other unwanted material to tobacco filler reclaimed from slit cartons.

According to a preferred embodiment of the present invention, the rotary hone sharpening apparatus comprises at least two cylindrical hones, each carried on a spindle. The spindles are mounted in bearing sleeves and coupled to a flexible drive shaft for high speed rotation. Flexible drive shafts facilitate the adjustable positioning of the hones relative to the cutting edge of the blade to be sharpened. At least one hone is positionable at each side of a blade cutting edge for sharpening the blade cutting edge. Sharpening is performed on a moving blade, with at least one hone rotating so that a contact surface of the hone is travelling in a direction opposite to the direction of travel of the blade and at least one bore rotating so that a contact surface is moving in the same direction as the direction of travel of the blade. The hone rotating opposite to the blade performs the sharpening operation and the hone rotating in the same direction operates to smooth and deburr the blade edge. According to a presently preferred embodiment, the hones rotate at least 15,000 rpm and more preferably at 20,000 rpm.

In another aspect of the invention, the hones are caused to execute several transverse movements to stroke the blade, exposing more of the hone abrasive to the blade edge to improve sharpening and evenly distribute the wear characteristics of the hones.

According to a further aspect of the invention, the bearing sleeves are each carried in a clamp which is mounted to a pneumatic rotary actuator. The clamps are pivotable for positioning the hones at an appropriate angle to the blade cutting edges. The actuator executes a pivot movement parallel to the plane of the blades causing the hones to move into an engagement location at either side of a blade. The rotary actuator is mounted to a linear actuator for moving the rotary actuator, and consequently the hones, in the direction of the blade width for a sharpening stroking movement.

The present invention provides a blade sharpening device which is installed on a carton slitting machine and can be operated by a machine operator, as needed, to sharpen the slitting blades. Through a circuit of interconnected timing devices, the blade sharpening device of the present invention automatically engages the blade cutting edge and performs a predetermined sharpening operation sequence without operator intervention.

A further aspect of the present invention provides a method for sharpening a scalloped edged blade in a carton slitting machine that includes the steps of reducing the linear speed of the cutting blade, rotating the cylindrical hones, engaging a cutting edge of a blade with the hones, stroking the cutting edge with the hones in a transverse direction several times as the hone rotate, directing air blasts at the hones to remove dust and debris, suctioning off the debris blown by the air blast, and disengaging the hones.

BRIEF DESCRIPTION OF THE DRAWING FIGURES

The present invention can be further understood with reference to the following description in conjunction with the appended drawings, wherein like elements are provided with the same reference numerals. In the drawings.

DETAILED DESCRIPTION OF PREFERRED EMBODIMENTS

Figure 1:
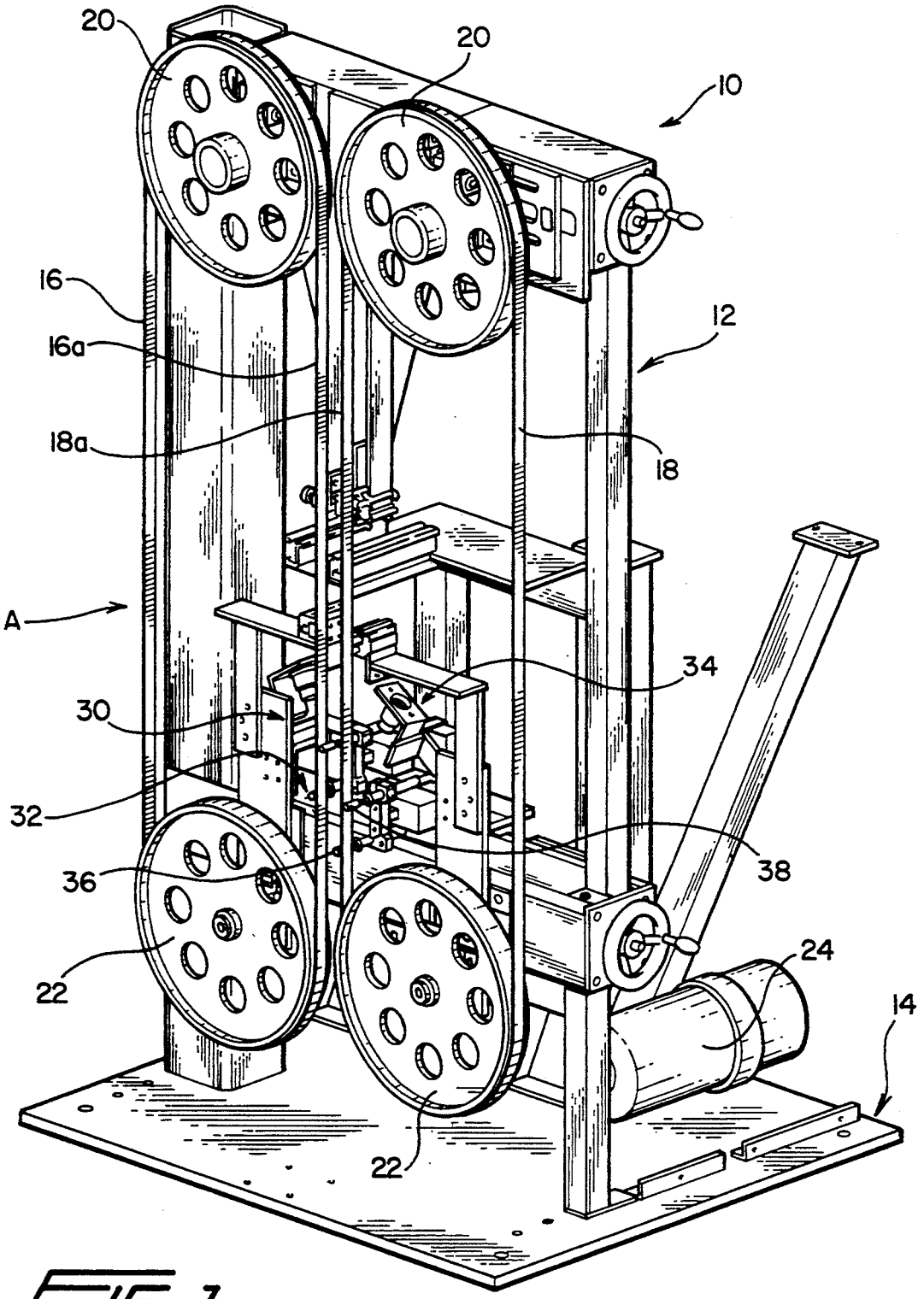
FIG. 1 is a perspective view of a carton slitting machine showing a blade sharpener assembly of the present invention, including two sharpening apparatuses.

FIG. 1 shows a carton slitter 10 for cutting open cigarette cartons to reclaim tobacco from the cigarette rods. The carton slitter 10 is described herein to provide a more complete understanding of the blade sharpener of the present invention, but does not constitute a part of the invention. The carton slitter 10 includes a frame 12 mounted on a base 14. Two slitter blades 16 and 18 are arranged on the carton slitter 10 in a parallel, spaced relationship a predetermined distance apart in the region between the pulleys. Cutting edges 16*a*, 18*a* of the blades 16, 18 are generally parallel and arranged to contact a carton in the same plane.

As used herein, "carton" refers to a box that contains several, generally ten, individual packets of cigarettes or smoking articles. A "packet" is used to refer to a package of several, typically twenty, cigarettes or smoking articles. In addition, the use of terms indicating direction or orientation, such as "right," "left" "upper," and "lower," are to facilitate the description of the invention as illustrated by the accompanying drawings and should not be given meaning otherwise.

The blades 16, 18 are scalloped edged, endless band blades as is known in the industry. Each blade 16, 18 is carried on an upper drive pulley 20 and a lower drive pulley 22. The upper 20 and lower 22 drive pulleys transmit drive force to the blades and maintain the blades 16, 18 in proper orientation and tension. A drive motor 24 mounted to the base 14 is connected to the pulleys 20, 22 by conventional means, for example a drive belt or chain, to drive the pulleys.

A carton feed conveyor and product and waste recovery conveyors have not been illustrated in FIG. 1, to provide a view of the underlying structure. As will be appreciated, cigarette cartons for slitting are conveyed to the blades 16, 18 at approximately the location and direction indicated by arrow A. The blades 16, 18 are positioned to slit a carton simultaneously on two operational planes. One blade slits a side panel of the carton, cutting the tops from individual packet tops to expose the cigarette rods. The second blade cuts through the carton and packets to separate the filters from the cigarette rods. The slit carton (which is now open at opposing sides) passes from the slitting machine to a unit that ejects the tobacco rods from the carton to a ripper machine that separates the tobacco from the paper tube.

As is understood in the art, cigarette packets generally include an outer plastic wrapper, a paper or paperboard package and an inner freshness wrapper of foil- or plastic-coated paper. The cigarette filters contain treated natural and artificial fiber materials. Slitting cartons, packets, and the contents is a high wear process, and blades tend to dull very quickly. In addition, friction from the blade 16, 18, melts the plastic package wrap and inner freshness wrapper, which leaves a residue that builds up on the blades 16, 18.

FIG. 1 shows a blade sharpener apparatus 32 of the present invention mounted in the frame 12 in proximity to the cutting edges 16*a* of the blade 16. A second blade sharpener apparatus 34 is mounted in proximity to the cutting edge 18*a* of the blade 18. The blade sharpener apparatuses 32, 34 are positioned on the frame 10 to be readily utilized for blade sharpening, but otherwise remain clear of the blades 16, 18 and the carton slitting process.

Figure 2:
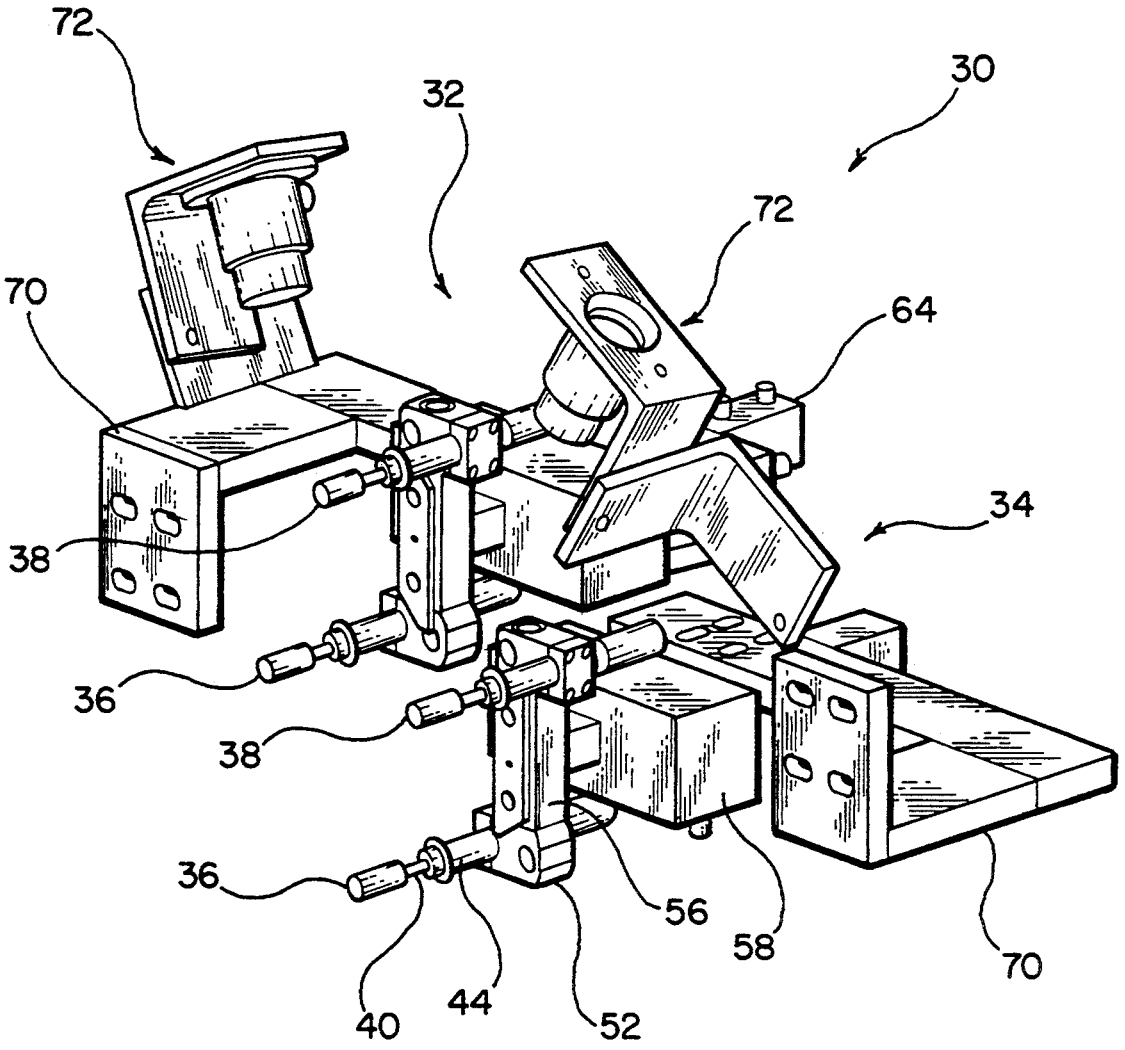
FIG. 2 is a perspective view of the blade sharpener assembly of FIG. 1.

FIG. 2 is a perspective view of the blade sharpener apparatuses 32, 34 removed from the carton slitting frame 10. Each of the apparatuses 32, 34 includes a pair of sharpening hones 36, 38, extending from the apparatus to the blades 16, 18. As seen in FIG. 1, the sharpening hones 36, 38 are positioned on opposing sides of the blades 16, 18. This permits the sharpening apparatus 32, 24 to engage both sides of the cutting edge 16*a*, 18*a* during a sharpening operation.

Figure 3:
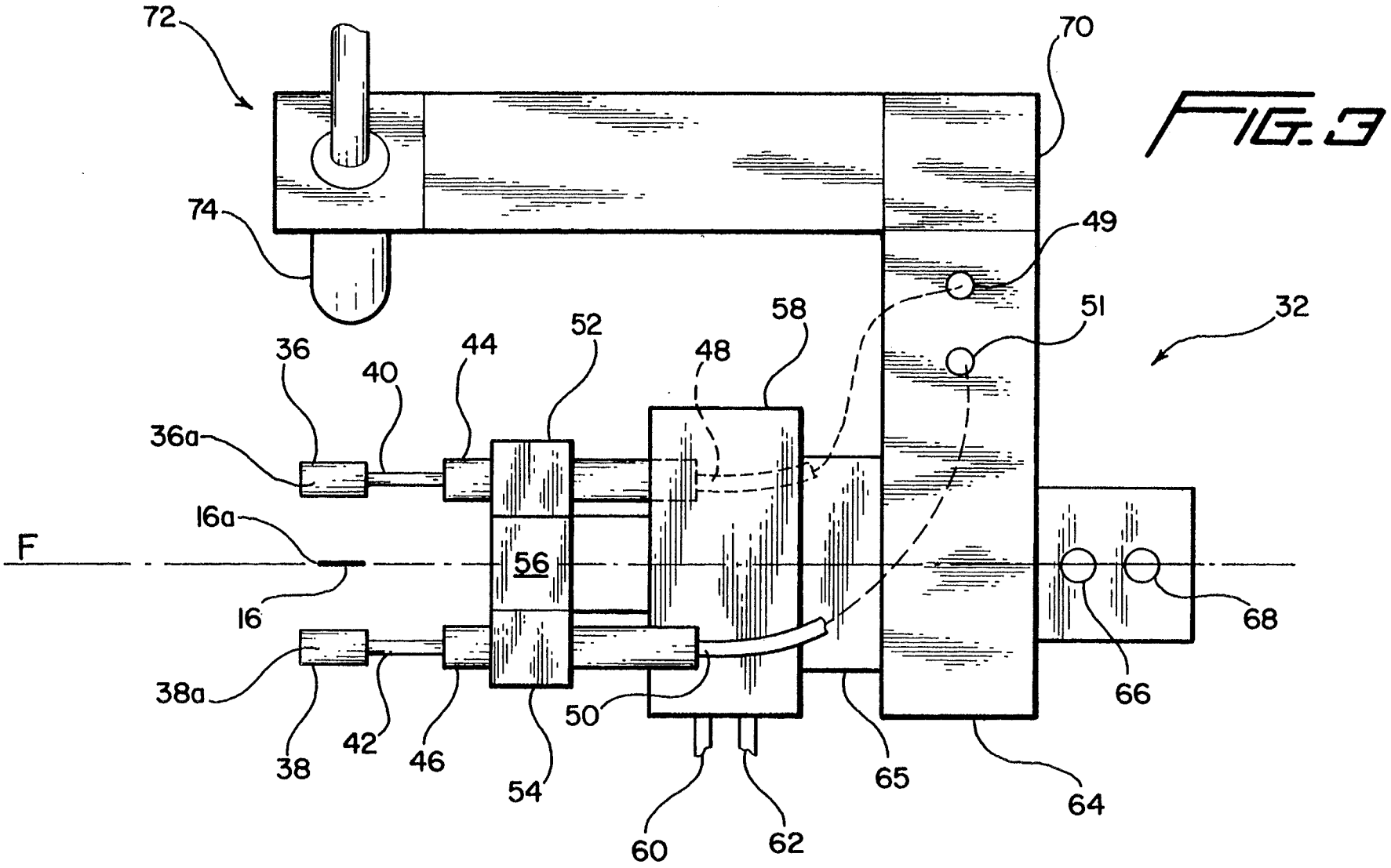
FIG. 3 is a top view of the blade sharpener of FIG. 2.

FIG. 3 is a top view of the sharpening apparatus 32 of FIG. 2. The apparatus is carried on a mounting bracket 70 that is mountable on the frame of the carton slitting machine 10.

The apparatus 32 includes a lower sharpening hone 36 and an upper sharpening hone 38. The hones 36, 38 are cylindrically shaped sharpening stones, one half inch in diameter, having an abrasive surface 36*a*, 38*a*. The abrasive characteristics of the hones 36, 38 are selected for sharpening the slitting blades as is known in the art. Each hone 36, 38 is carried on a spindle 40, 42, respectively. The spindles 40, 42 are each mounted in a bearing sleeve, 44, 46 that is coupled to a flexible drive shaft 48, 50 (shown in part). The flexible drive shafts 48, 50 transmit rotational force to the spindles 40, 42 for rotating the stones 36, 38. The flexible drive shafts 48, 50 are coupled to drive motors 49, 51 which provide the drive force to rotate the hones. The use of flexible drive shafts allows the motors 49, 51 to be remotely located from the bearing sleeves 44, 46 in a convenient location. The drive motors 49, 51 are shown mounted on the mounting bracket 70, and may be, alternatively placed at other convenient locations.

Each of the bearing sleeves 46, 48 is mounted in a clamp 52, 54 attached at opposing ends of a pivot rod 56. The clamps 52, 54 are pivotably mounted on the pivot rod 56 to permit the hones 36, 38 to be set at a desired angle in relation to the cutting edge 16*a* for forming a bevel during sharpening. The pivot rod 56 is rotatably coupled to a pneumatic rotary actuator 58. The rotary actuator 58 causes the pivot rod 56 to rotate about axis F to bring the hones 36, 38 into engagement with the blade edge 16*a*. The rotary actuator 58 is provided with two pneumatic fittings 60, 62 to couple the rotary actuator to a source of pressurized air (not shown) for pneumatically controlling the rotation of the pivot rod 56.

The rotary actuator 58 is attached to a linear actuator 64. The linear actuator 64 has a slide 65 that moves along axis F. Movement of the slide 65 causes the rotary actuator 58 and, consequently, the hones 36, 38, to move parallel to axis F. The linear actuator provides reciprocal movement of the hones 36, 38 is provided for stroking the blade edges 16*a*, during sharpening, as has been described. The linear actuator 64 is provided with two pneumatic fittings 66, 68 to couple the linear actuator 64 to a source of pressurized air (not shown) for pneumatically operating the slide.

The linear actuator 64 is fastened to the mounting plate 70 for mounting the sharpening apparatus 32 to the carton slitting machine frame 12.

The sharpening apparatus 32 of the present invention is provided with means 72 for removing dust and debris from the blades and hones during the sharpening operation. In a preferred embodiment of the invention, the means for removing dust and debris comprises an air flow amplifier 74 arranged to direct a blast of air onto the hones and blade. The air flow amplifier 74 is connected to a source of pressurized air (not shown) and serves to direct and concentrate an air flow for blowing, from the blade 16 and hones 36, 38, metal dust from sharpening and the paper, plastic and other debris that collects on the hones during sharpening.

Figure 4:
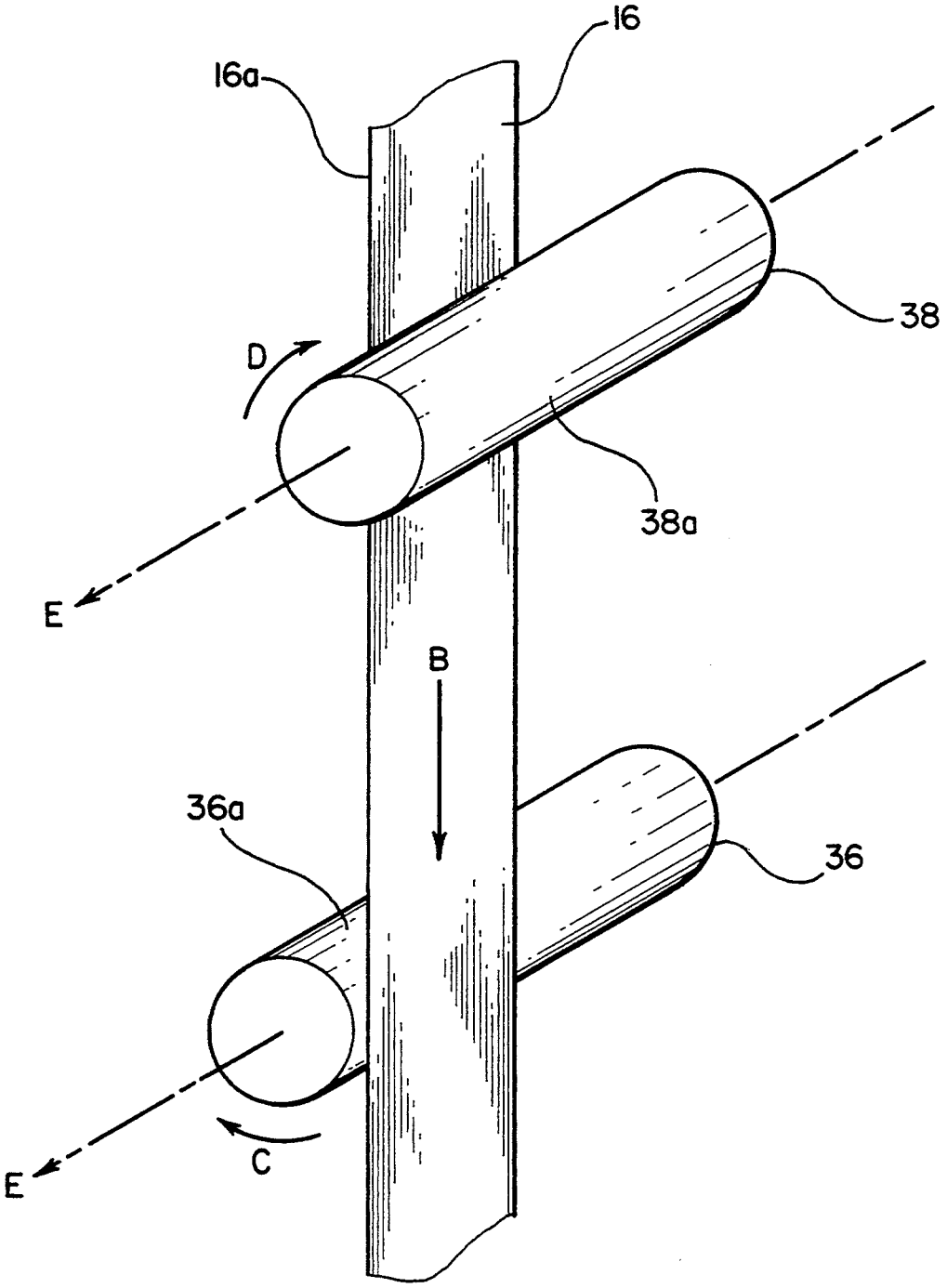
FIG. 4 is a schematic end view of the hones of FIG. 2 contacting the blade; and, FIG. 5 is a schematic diagram of a pneumatic actuator control for controlling the movement of sharpening hones.

FIG. 4 is a schematic view of the hone 36, 38 positions relative to the blade 16 for sharpening. The hones 36, 38 are positioned on opposing sides of the blade 16, and vertically spaced apart, with hone 38 positioned above hone 36.

The direction of travel of the blade, from top to bottom, is indicated by arrow B. During the sharpening sequence, the operational blade speed of about 4500 to 5500 feet per minute is reduced to a sharpening speed of about 450 to 690 feet per minute. The slowing of the blade 16 is necessary to maintain good contact between the hones 36, 38 and the blade and scallops. At the high operational speed and with the high tension of the blade 16, the scalloped edges of the blade bumping against the hones 36, 38 would cause an oscillation in the blade resulting in the hones intermittently losing contact with the blade edge. It has been found that at a lower speed, which is 690 feet per minute in a presently preferred embodiment, the hones 36, 38 are able to maintain continuous contact with the blade 16.

The hones 36, 38 are moved by the rotary actuator to contact the cutting edge 16a with sufficient contact pressure to deflect slightly the edge 16*a* of the blade 16. The slight twist, and resulting torsion in the blade 16 as it passes from the upper hone 38 to the lower hone 36 assists in the hones maintaining contact with the blade during sharpening.

The hones 36, 38 are angled so that honing surfaces 36*a* and 38*a* contact the blade 16 at the cutting edge 16*a* for forming a desired bevel on to the edge. In a preferred embodiment of the invention, the hones are angled so that a 5° bevel is formed in sharpening. In practice, the hones 36, 38 are angled at 7° to 10° to the operational plane of the blade 16 to ensure that the hones contact the blade at the cutting edge 16*a*. Because the blade 16 is deflected by the contact pressure with the hones 36, 38, the desired blade bevel of 5° is formed.

Generally, a critical minimum relative speed between the honing surface and the workpiece is required to generate the friction necessary to effect the removal of material from the workpiece, and consequently, sharpen the workpiece. The minimum relative speed varies according to the hone abrasive selected and the material being sharpened. Generally, beyond the minimum required speed, the faster the hone is moving, the better it can sharpen the workpiece. The hones of the present invention are rotated at a speed of at least 15,000 rpm to achieve good sharpening. In the presently preferred embodiment, the hone rotation speed is 20,000 rpm. A higher speed might be more desirable, however, rotational speed is limited by the available technology. At present, shaft drive mechanisms, for a variety of reasons, are not capable of rotational speeds above 20,000 rpm.

The hones 36, 38 are shown having the same sense of rotation, which, for the purposes of illustration, is clockwise, as indicated by arrows C and D in FIG. 4. As illustrated in FIG. 4, the contact surface 38*a* of the upper hone 38 moves in a direction opposite the direction of travel B of the blade 16. The relative speed of the hone 38 to the blade 16 is therefore the addition of the surface speed of the hone and the speed of the blade. Counter-directional rotation results in a greater speed than is possible by rotation of the hone 38 alone, and therefore improves the honing operation by increasing the relative speed. Counter-directional rotation of the hone 38 thus serves to impart a high quality sharpness and smoothness to the cutting edge 16*a*.

The surface speed of the half inch diameter hones 36, 38, ranges from about 1960 feet per minute at 15,000 rpm to about 2620 feet per minute at 20,000 rpm. Taking into account the speed of the blade, and in a presently preferred embodiment of 20,000 rpm hone rotation, the upper hone 38, rotating against the blade, thus has a surface speed relative to the blade of about 3310 feet per minute. The lower hone 36, rotating with the blade 16, has a surface speed relative to the blade of about 1925 feet per minute. The surface speed of the hones 36, 38, which is much higher than the speed of the blade 16, is advantageous in imparting the desired sharpness and finish characteristics to the blade edge 16*a* in relatively short contact time.

During sharpening against the scalloped edges, however, the upper hone 38 tends to leave burrs and ragged metal filings on the opposing side of the blade 16 in contact with the lower hone 36. To remove the burrs, the contact surface 36*a* of lower hone 36 moves in the same direction B as the blade 16. Same direction surface movement results in a lower relative speed, i.e., the subtraction of the blade speed from the surface speed of the hone. In the present embodiment, the relative speed between the lower hone 36 and the blade 16 is below the critical sharpening speed. This has the effect of causing the hone 36 to deburr and smooth the edge 16*a* of the blade 16, but, because no significant additional sharpening occurs, the lower hone 36 does not create additional burrs or metal filings on the opposite side of the blade which would have to be removed.

During the sharpening sequence, the hones 36, 38 execute repeated reciprocal axial movement along axes E. The reciprocal movement strokes the blade edge 16*a* as the hones 36, 38 rotate to maximize the area of the hone surfaces 36*a*, 38*a* used in sharpening. By stroking the blade 16, the hones, 36, 38 present a continually refreshed abrasive surface to the blade, which improves the sharpening capability of the hones. In addition, stroking distributes wear and heat from friction evenly on the hones 36, 38, which extends the life of the hones.

Figure 5:
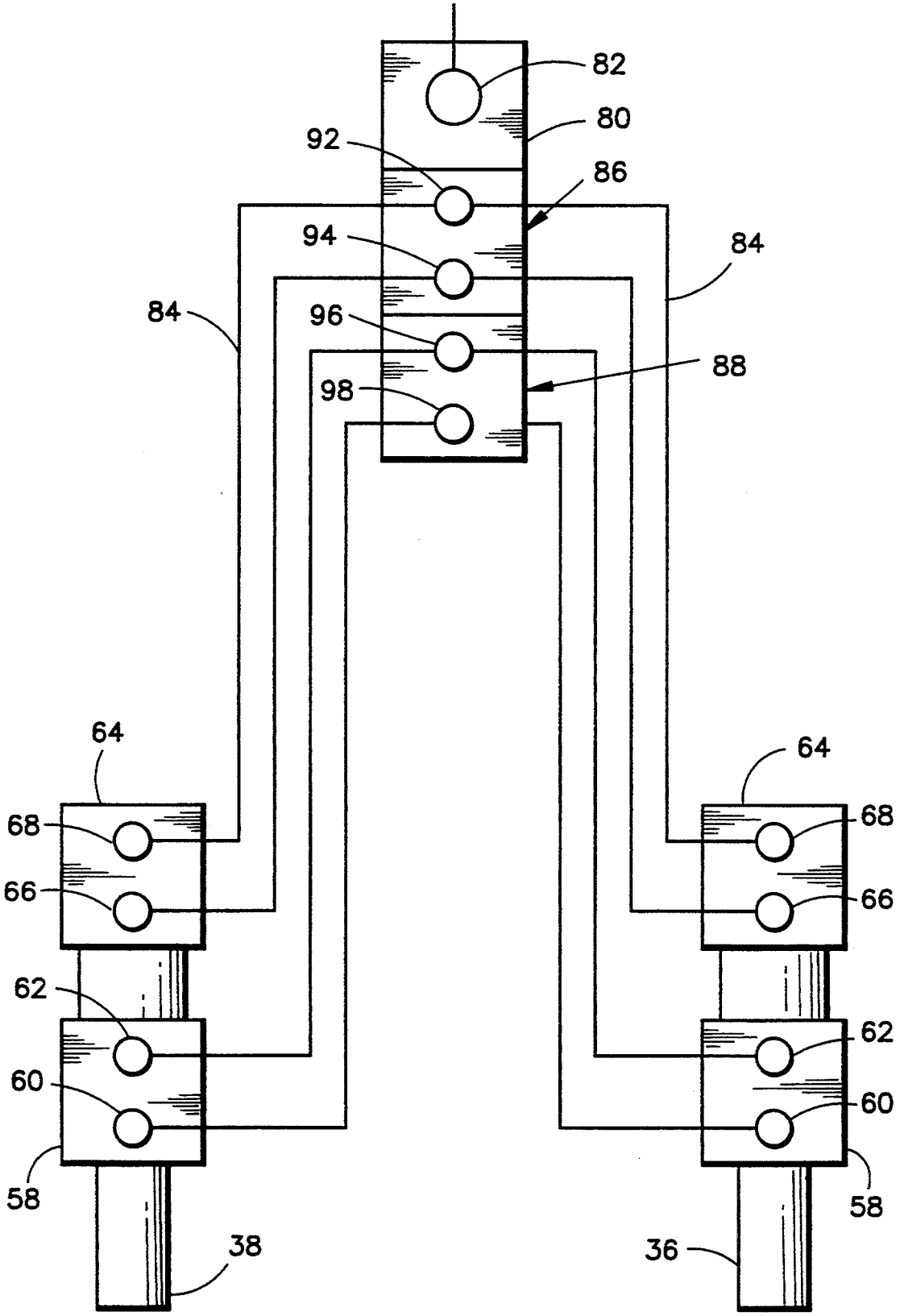

FIG. 5 is a schematic diagram for pneumatic control of the sharpener apparatus 32. A pneumatic control block 80 has an inlet port 82 connecting to a source of pressurized air (not shown). In a preferred embodiment of the invention, the air source supplies pressurized air at 12 to 14 psi. The control block 80 includes four-way valves 86 and 88. Valve 86 controls the air flow to outlet ports 92 and 94, and valve 88 controls the air flow to outlet ports 96 and 98. The outlet ports 92–98 are connected to the rotary actuators 58 and linear slides 64 of the hones 36, 38 by air lines 84.

The rotary actuator 58 and linear slide 64 are pneumatically actuated. Air directed to appropriate inlet fittings produces a desired action by the rotary actuator 58 and linear slide 64, as follows. Air directed from outlet port 92 to fittings 68 causes the linear slide 64 to extend for moving the hones 36, 38 in a forward stroke during sharpening (in the direction of arrow E in FIG. 4). Air from outlet port 94 to fittings 64 causes the linear slide 64 to retract for pulling the hones 36, 38 back to a recovery position. During sharpening, outlet ports 92 and 94 are cycled to produce the reciprocating stroking movement described above.

Directing air from an outlet 96 to the pneumatic fittings 62 of the rotary actuator 58 causes the rotary actuator to pivot to bring the hones into engagement with the blade to initiate the sharpening sequence, which rotation, in FIG. 3, is counterclockwise from the left about axis F. Directing air from an outlet 98 to the fittings 60 causes the rotary actuator to rotate clockwise to disengage the hones from the blade 16.

The sharpening sequence, and method using the sharpening apparatus of the present invention, will now be described in more detail. The sharpening operation is initiated by an operator, but is carried out automatically. As has been mentioned, carton slitter blades 16, 18 require frequent sharpening to maintain an edge sufficiently sharp for high quality recovery of tobacco, that is, recovery of tobacco with minimal levels of unwanted matter. It has been found that in continuous carton slitting operations, the blades require sharpening after use on a few hundred cartons, which can be four to five minutes use.

The sharpening sequence is initiated by an operator, which may be done by a button or switch to activate a conventional timing and switching circuit (not illustrated). A master timer to control the duration of the sharpening operation is first activated, and various timers and controls are subsequently activated to initiate and control the following steps. The slitting blades are slowed from the operative speed of about 4500 feet per second to about 690 feet per second. Once the blades are slowed, the hones begin rotation and are accelerated to an operating speed of 15,000 to 20,000 rpm. The hones are rotated so that an upper hone is rotating counter to the blade direction and a lower hone is rotating in the same direction as the blade.

After the slitting blade has slowed to sharpening speed, and the hones have accelerated to sharpening speed, the rotary actuator is activated for bringing the hones into contact with the blade. This actuator causes the pivot rod to pivot the hones into contact with the blade and apply sufficient laterally directed force to deflect slightly the blade edge out of the operational plane in which the blade travels. A slight twist thus applied to the blade helps the hones maintain contact with the blade during sharpening.

The linear slide is then activated to move the hones reciprocally in an axial direction to stroke the blade edge at a rate of approximately once per second. The sharpening sequence is timed for 12 to 30 seconds duration. At the end of the sequence, the linear slide stops and the rotary actuator is reversed to disengage the hones from the blade. The hone rotation is then stopped, and the slitting blade is accelerated to slitting speed. The operator then resumes carton slitting operations.

To facilitate cleaning of the blades 16 and 18 of debris and burrs during or between slitting operations of the carton slitter 10, a plurality of brushes or other suitable cleaning devices are attached to the pivot rods 56 so as to pivot therewith. Preferably, a brush is provided adjacent each of the hones 36, 38, but on the opposite side of the respective blade from the hone so that when the pivot rods 56 rotate the hones 36, 38 away from the blades 16, 18, the brushes are rotated toward a position that operatively engages the brushes with the blades 16 and 18.

With this provision of cleaning brushes, the rotary actuator 58 is modified to include a pneumatic control valve that provides the pivot rods 56 three operative positions, one for engaging the hones 36, 38 for sharpening, a second operative position for engaging the brushes for cleaning and a third neutral position therebetween to allow the blades to move freely between the hones and the brushes during slitting operations.

The above-described embodiments should be regarded as illustrative rather than restrictive, and it should be appreciated that variations, changes and equivalents may be made by others without departing from the scope of the present invention as defined by the following claims.

What is claimed is:

1. A method for sharpening a band blade in a machine, comprising the steps of:

running a band blade in a machine at a sharpening speed;

rotating a first cylindrical hone so that a surface of the first hone is moving counter to the blade direction;

rotating a second cylindrical hone so that a surface of the second hone is moving in the blade direction;

moving the first and second hones in a direction transverse to a blade length and parallel to a blade width;

moving the first and second hones relative to a cutting edge of the blade to contact one side of the cutting edge at a preselected sharpening angle with the first rotating hone for sharpening the cutting edge to contact an opposing side of the cutting edge at a preselected angle with the second rotating hone for deburring the cutting edge; and, moving the hones in repeated reciprocal movements transverse to the blade direction to stroke the cutting edge as to hones rotate.

2. The method as claimed in claim 1, further comprising the steps of:

directing a blast of air at the hones for cleaning the blade and hones of loose material; and collecting loose material cleaned by the air blast.

3. The method as claimed in claim 1, wherein the blade is a scalloped-edge blade and the sharpening speed is about ⅛ to 1/10 of an operational slitting speed.

4. The method as claimed in claim 1, wherein the first and second hones are rotated so that a speed of the surface of each of the hones is greater than the sharpening speed of the blade.

5. The method as claimed in claim 1, wherein the first and second hones are rotated so that a speed of the surface of each of the hones is in the range of about 1960 feet per minute to 2620 feet per minute.

6. The method as claimed in claim 1, wherein the first and second hones are rotated at 15,000 to 20,000 revolutions per minute.

7. The method as claimed in claim 1, wherein the first and second hones are moved in repeated reciprocal movement at a rate of once per second while both of the hones are in contact with the blade during the sharpening operation.

8. The method as claimed in claim 1, wherein the reciprocal movement of the first and second hones is controlled so that duration of contact with the blade is equally distributed along the hone surface.

9. The method as claimed in claim 1, wherein the first and second hones contact the blade edge with sufficient lateral force to deflect the blade from an operational plane.

10. The method as claimed in claim 1, wherein the first and second hones contact the blade edge at an angle of 7° to 10° to the operational plane of the blade.

11. An apparatus for sharpening an endless band blade in a slitting machine, comprising:

a frame mountable on a slitting machine;

a first actuator, mounted on the frame, for movement transverse to a blade length direction and parallel to a blade width direction;

a second actuator mounted to the first actuator for movement relative to a blade cutting edge plane;

a first cylindrical rotatable hone attached to the second actuator and extending in the blade width direction;

a second cylindrical rotatable hone attached to the second actuator and extending in the blade width direction;

means for rotating the first and second hones;

means for controlling the first actuator for repeated reciprocating movement of the second actuator and the first. and second hones; and, means for controlling the second actuator so that movement of the second actuator in a first direction causes the first and second hones to move into contact with a cutting edge of the blade for sharpening and movement in a second direction causes the first and second hones to move out of contact with the cutting edge.

12. The apparatus as claimed in claim 11, wherein the second actuator includes a pivot bar having an upper and lower end, the first hone being attached to the upper end of the pivot bar and extending in the blade width direction and the second hone being attached to the lower end of the pivot bar and extending in the blade width direction, wherein the second actuator executes a pivoting movement to bring the first and second hones into contact with the blade edge.

13. The apparatus as claimed in claim 11, further comprising an air amplifier for blowing pressurized air on the first and second hones and blade to remove debris from sharpening.

14. The apparatus as claimed in claim 11, wherein the means for rotating the hones rotates the first hone so that a surface of the first hone travels opposite to the direction of travel of the blade and rotates the second hone so that a surface of the second hone travels in the same direction of travel as the blade.

15. The apparatus as claimed in claim 11, wherein the means for rotating the first and second hones includes a motor coupled to the hones by a flexible drive shaft.

16. The apparatus as claimed in claim 11, wherein the means for rotating the first and second hones rotates the hones at 15,000 to 20,000 rpm.

17. The apparatus as claimed in claim 11, wherein the means for rotating the first and second hones rotates the hones for a surface speed in the range of about 1960 feet per minute to 2620 feet per minute.

18. The apparatus as claimed in claim 11, wherein the first and second hones are positioned to contact the blade edge at an angle for forming a 5° bevel on the edge.

19. The apparatus as claimed in claim 18, wherein the first and second hones are positioned to contact the blade edge at an angle of 7° to 10° to the operational plane of the blade.

20. The apparatus as claimed in claim 11, wherein the first actuator is operated pneumatically, and the means for controlling the first actuator includes a valve to control the flow of pressurized air to the first actuator.

21. The apparatus as claimed in claim 11, wherein the second actuator is operate pneumatically and the means for controlling the second actuator includes a valve to control the flow of pressurized air to the second actuator.

22. The apparatus as claimed in claim 11, wherein the means for controlling the first actuator causes reciprocal movement of the first and second hones so that contact with the blade is equally distributed along a hone surface.

23. The method as claimed in claim 1, wherein the steps of contacting one side of the cutting edge and contacting an opposing side of the cutting edge comprise moving the first rotating hone from a position out of contact with the band blade to a position in contact with the band blade, and moving the second rotating hone from a position out of contact with the band blade to a position in contact with the band blade.

* * * * *